United States Patent [19]

Zilkha

[11] Patent Number: 5,020,834

[45] Date of Patent: Jun. 4, 1991

[54] WINDOW GATE CONSTRUCTION

[76] Inventor: Uri Zilkha, 307 Third Ave., New York, N.Y. 10010

[21] Appl. No.: 510,842

[22] Filed: Apr. 18, 1990

[51] Int. Cl.[5] ..... E06B 3/68

[52] U.S. Cl. ..... 292/74; 49/56; 292/189

[58] Field of Search ..... 49/55, 56, 57; 292/74, 292/189

[56] References Cited

U.S. PATENT DOCUMENTS

| | | | |
|---|---|---|---|
| 453,881 | 6/1891 | Collins | 292/74 |
| 484,489 | 10/1892 | Blaine | 292/74 |
| 560,356 | 5/1896 | Hull | 292/74 |
| 1,438,547 | 12/1922 | O'Connor . | |
| 1,515,612 | 11/1924 | O'Connor | 70/91 |
| 2,091,036 | 8/1937 | Glaser | 292/74 |
| 2,379,528 | 7/1945 | Kelliner | 292/74 |
| 2,475,392 | 7/1949 | Juszczak | 292/74 |
| 3,722,236 | 3/1973 | Zelenko | 65/52 |
| 4,249,345 | 2/1981 | Littleton | 49/56 |
| 4,274,228 | 6/1981 | Kondracki | 49/56 |
| 4,452,011 | 6/1984 | Trombettas | 49/56 |
| 4,575,965 | 3/1986 | Iverson | 49/50 |
| 4,624,072 | 11/1986 | Zilhka | 49/55 |
| 4,630,396 | 12/1986 | Zadokzvi | 49/55 |
| 4,631,862 | 12/1986 | Gallardo | 49/56 |
| 4,677,789 | 8/1987 | Merhy | 49/56 |
| 4,937,975 | 7/1990 | Zilkha | 49/56 |

*Primary Examiner*—Eric K. Nicholson
*Attorney, Agent, or Firm*—Charles E. Temko

[57] ABSTRACT

An improved lockable windowgate having manually operated latching menas for retaining a locking member in retracted condition against the force of gravity during the time period in which the gate is opened, so as to facilitate one-handed operation by a user. Several embodiments are disclosed. In a preferred embodiment, the latching member is in the form of a detent disengaged by downward pressure on the locking member.

3 Claims, 2 Drawing Sheets

WINDOW GATE CONSTRUCTION

RELATED APPLICATION

Reference is made to the co-pending application of Uri Zilhka, Ser. No. 07,374,722, filed July 3, 1989, now U.S. Pat. No. 4,937,975, which discloses and claims a related invention.

BACKGROUND OF THE INVENTION

This invention relates generally to the field of windowgates which are installed in the openings of conventional double hung and outwardly pivoted windows in locations having relatively high incidence of crime, and more particularly to an improved form thereof offering improved adjustability and improved convenience in use with respect to the locking elements thereof.

In gates of this type, it is not practicable to provide locking means requiring a key, since upon the occurrence of an emergency, it is usually necessary for the occupants of the building to have immediate egress accessibility. As described in prior U.S. Pat. No. 4,274,218, granted July 23, 1981, it is known to configure the gate to include a shield over the locking mechanism, whereby access to the same from the outside of the building is impossible, while access to an occupant of the building is readily available.

In my above mentioned copending application, there is disclosed an improved form of locking mechanism in which a locking member is enclosed within a tubular shield leaving only the manually engageable member within an area accessible only to persons located interiorly of the window. This locking member is lifted by the user against the force of gravity to unlock the gate for swinging motion relative to the frame in which it is mounted. While the locking member may be then released, it must again be lifted to enable locking projections to clear before the gate is again placed in coplanar relation relative to the frame. More importantly, the locking bar must be manually held in its upper position while the gate is swung to open condition, which, in the case of relatively feeble persons or children, is not an easy one-handed operation. Depending upon the location of the window relative to the standing position of the user, the use of two hands to accomplish this purpose may be equally difficult, if not impossible.

SUMMARY OF THE INVENTION

Briefly stated, the invention contemplates the provision of an improved window gate construction of the class described in which the above mentioned disadvantage has been substantially resolved. To this end, each of the disclosed embodiments is provided with a vertically movable locking member having resiliently biased latching means for maintaining the locking member in elevated condition, in which the gate is unlocked for swinging movement until such time as it is manually released allowing the locking member to then descend under the action of gravity to the locking position. Thus, during the course of opening the gate, the locking member is first raised to its upper latched condition, which also corresponds to the unlocked condition of the gate. The gate may then be subsequently swung inwardly to open position. When it is desired to close and again lock the gate, the gate is swung to closed position, and the latch member subsequently manually released to allow the locking member to descend to its locked condition. Since at no time is force exerted by the user simultaneously in two directions, the operation of the gate is essentially a single-handed operation. The advantage of this construction is particularly appreciated by those who must use the other hand to steady themselves during the opening of the gate because of their own infirmity, or the location of the gate relative to the user.

In a first embodiment of the invention, the latching means may be of a type resembling a conventional so-called night latch including a housing in which a resiliently urged latch member project outwardly thereof to selectively engage a corresponding opening in the locking member after penetrating a corresponding opening in the tubular shield which encloses it. The latch includes a laterally extending projection riding in a corresponding slot in the housing accessible to the user.

In a second embodiment, the latching function is accomplished by a manually retractible resiliently urged plunger carried by a frame mounted upon the gate. Since this latching function serves solely to maintaining the latching member in opened condition, it is not necessary that it be inaccessible to an intruder, that is to say access to the latch does not enable the intruder to unlock the gate.

In a third embodiment, the latching function is performed by a resiliently-urged ball detent riding in a horizontally oriented bore and engaging a corresponding recess in the locking member. The detent is released by exerting a downward pressure on a manually accessible lever associated with the locking member.

BRIEF DESCRIPTION OF THE DRAWINGS

In the drawings, to which reference will be made in the specification, similar reference characters have been employed to designate parts throughout the several views.

DETAILED DESCRIPTION OF THE DISCLOSED EMBODIMENTS

Figure 1:
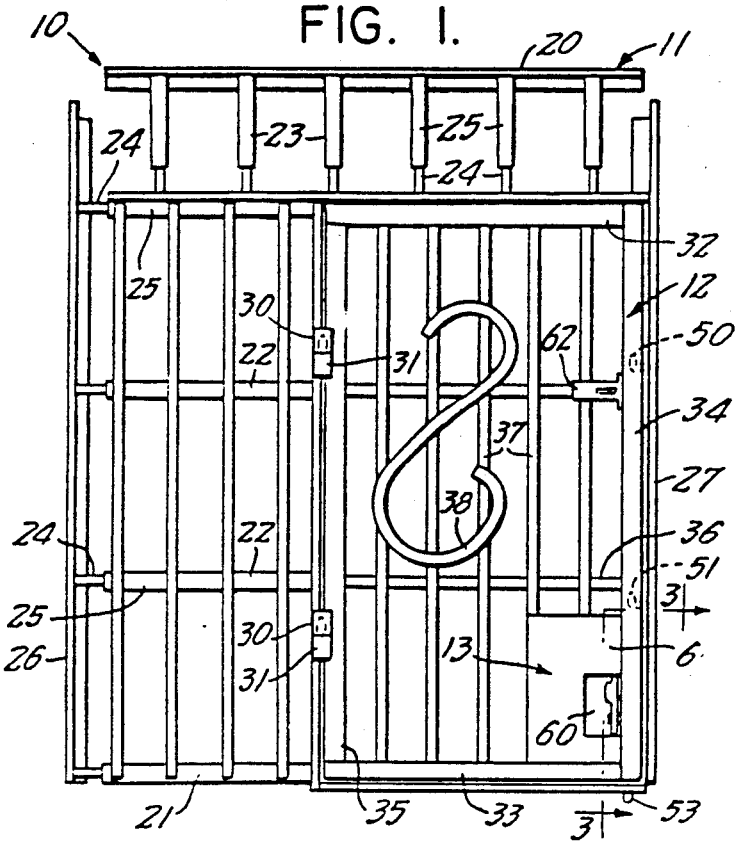
FIG. 1 is an elevational view of a first embodiment of the invention showing a side facing the interior of a surrounding opening.

In accordance with the first embodiment of the invention, the device, generally indicated by reference character 10, comprises broadly: a relatively fixed frame element 11, a pivotally mounted gate element 12, and a manually operated locking mechanism 13. As is customary with window gates of the disclosed type, the locking mechanism 13 is so configured and shielded as to make the same accessible only to a person located inwardly of the window opening in which the device is installed.

The fixed frame element 11 is preferably formed of welded angle iron or similar material, and includes upper and lower end rails 20 and 21, respectively, a plurality of medially positioned horizontal members 22, a plurality of medially positioned vertical members 23, each including telescopic male and female parts 24 and 25, respectively. Side rails 26 and 27, together with end rails 20 and 21 are normally secured within a window opening (not shown) by lag screws, expansion bolts or the like. Fixed vertical and horizontal rails 28 and 29 define a rectangular opening in which the gate element 12 is movably positioned.

The gate element 12 is also preferably of welded steel construction and includes open-ended hinged means 30 which cooperates with pintles 31 on the frame element so that the gate element may be manually disconnected during installation. It includes upper and lower edge members 32 and 33, first and second vertical members 34 and 35, horizontal medially positioned members 36 and medially positioned vertical members 37 as well as an optional decorative member 38.

The locking mechanism 13 includes a hollow channel-forming member which may be a part of the vertical member 34 in which the channel 40 communicates with plural composite slot openings 41 and 42, each including a vertical portion 43 and a horizontal portion 44. A lower vertical slot 45 provides for manual operation, as will appear hereinafter. Disposed within the channel is an elongated bar 47 having corresponding openings 48 and 49.

The frame element 11 is provided with curved projections 50 and 51 which are engaged by the edges of openings 48 and 49 to effect a locking action. The lower end of the bar 52 mounts a pintle 53, the lower end of which engages an orifice 54 in the horizontal member 22 to effect an additional locking point.

Figure 2:
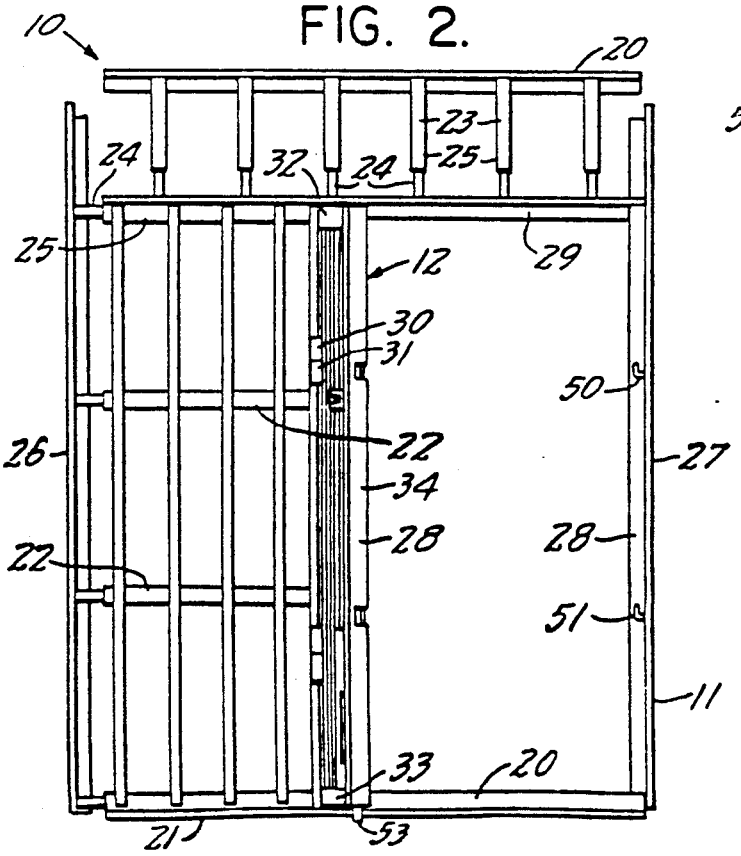
FIG. 2 is a similar elevational view thereof showing the gate in opened condition, and partly broken away to show detail.
Figure 3:
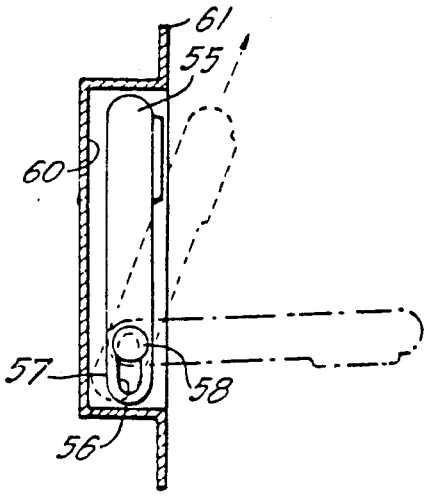
FIG. 3 is a view in elevation showing a locking bar forming a part of the first embodiment.
Figure 4:
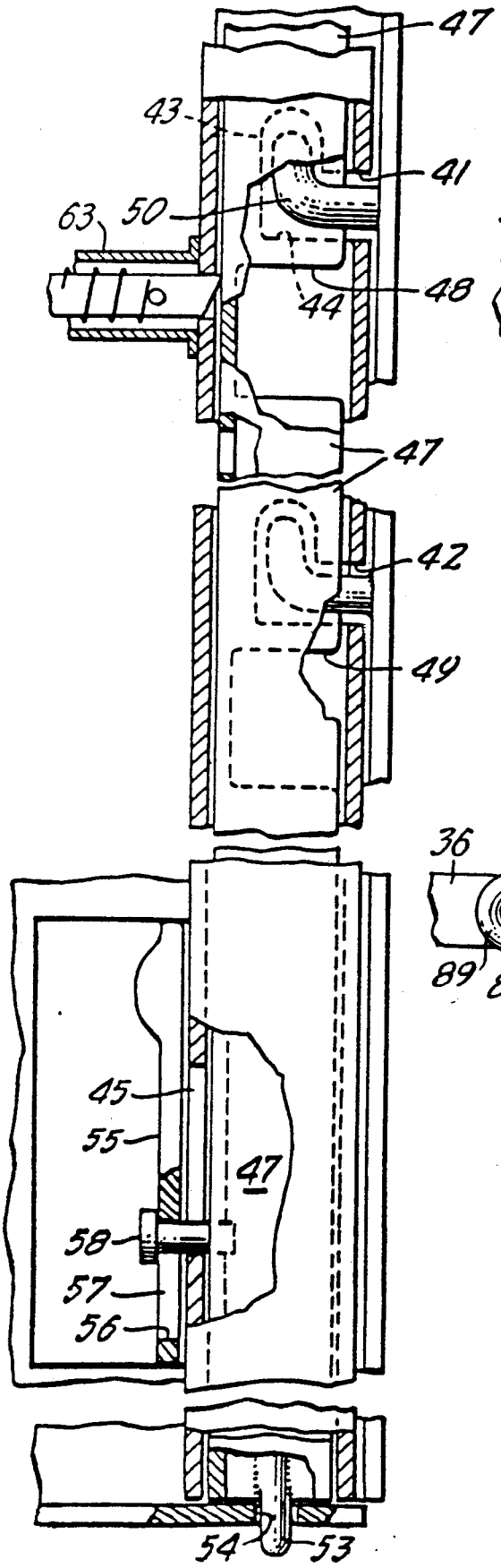
FIG. 4 is an enlarged fragmentary elevational view corresponding to the right hand portion of FIG. 2.

An operating lever 55 includes a slotted opening 56 at a lower end 57 thereof which engages a pintle 58 on the bar 57. The lever is positioned within a rectangular recess 60 and a rectangular plate 61 which is welded to the inner surface of the gate element 12. From a consideration of FIGS. 1 and 2, it will be apparent that in order to unlock the gate element with respect to the frame element, it is necessary to move the lever 55 directly upwardly until the lower end 57 of the slot 56 is in contact with the pintle 58, at which point it may be pivoted outwardly of the recess toward the building occupant, who can then move the bar 47 in an upwardly vertical direction to effect unlocking, following which the gate 12 may be swung out of the plane of the frame element to offer egress to the occupant in the case of an emergency.

It will be apparent that during such swinging operation, it is necessary for the user to maintain an upward force on the lever 55, at least until the free vertical edge of the gate is clear of the frame element 11 in order to prevent the force of gravity from shifting the bar 47 downwardly to re-effect the above described locking action. Thus, both an upward force and a horizontally directed force is necessary to open the gate. In the above identified application these forces must be applied simultaneously, a feat not easily accomplished using a single hand, the weight of the bar 47 normally being substantial.

Figure 5:
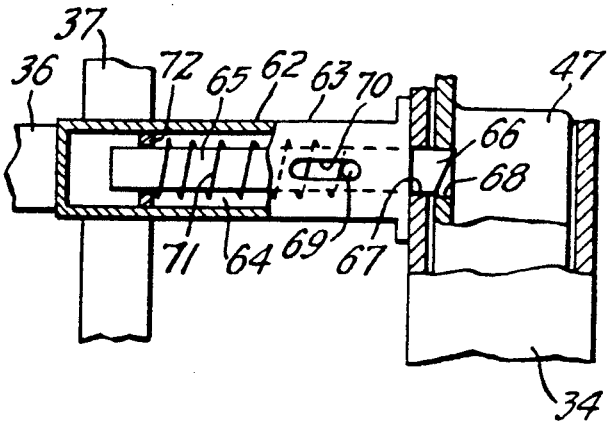
FIG. 5 is an enlarged fragmentary view in elevation, partly broken away to show detail of a locking member latching means forming a part of the embodiment.
Figure 6:
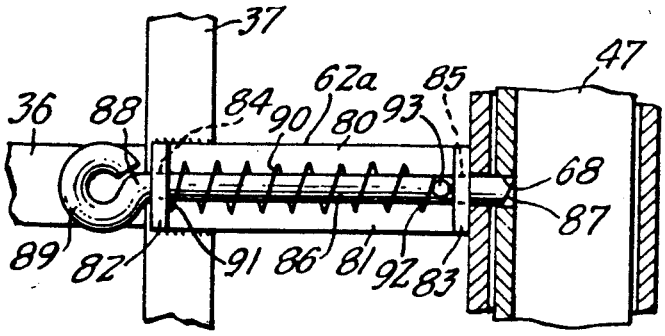
FIG. 6 is an enlarged view in elevation corresponding to that seen in FIG. 5, but showing a second embodiment of the invention.

FIG. 5 illustrates novel structure which resolves this problem in the form of a means for selectively holding the bar 47 in the upper or unlocked position. This means, generally indicated by reference characters 62 includes a generally rectangular housing 63 forming a hollow recess 64 in which a reciprocating resiliently urged latch member 65 is slideably positioned. The free outer end 66 is adapted to enter opening 67 in vertical member 34 and opening 68 in bar 47 when the same are in aligned condition which occurs when the bar 47 is at its upper most point of travel. The latch member 65 includes a laterally extending pin 69 riding in a slotted opening 70 in the housing 63, the outer end of which is manually engageable. A compression spring 71 bears upon the pin 69 at one end thereof and against an inner surface 72 of the housing 63 at the other end thereof.

In the second embodiment, the means **62*a* is somewhat simplified. The housing 63 is replaced by a U-shaped stamping 80 including a main wall 81, a surface of which is welded to the inner surface of the gate element 12, and end walls 82 and 83 forming aligned openings 84 and 85 which support a latch member 86. The latch member 86 may be formed from relatively large diameter steel wire, and includes a free end 87 and a second free end 88 having manually engageable terminal 89 thereon. A spring 90 includes a first end 91 engaging the end wall 82 and a second end 92 engaging a laterally extending pin 93**.

When the device 10 is open, the procedure is as described above. However, the member 47 upon being raised to its upper limit of travel is engaged by the means 62 and retained thereat, this being accomplished before any attempt is made to move the gate from coplanar relation with respect to the frame element 11. At this point, relatively little force is required to swing the gate for the purpose of providing egress to the building occupant, or for merely washing the window behind which the device 10 is located. The member 47 remains in this position until it is desired to close the gate, following which only a simply horizontally directed force is necessary to unlock the means 62 following which the member 47 falls under its own weight to again re-lock the gate with respect to the frame. It is therefore unnecessary to maintain an upward force while the gate is being initially moved from coplanar relation with respect to the frame, or when returning the gate to closed position.

Since the means 62 does not actually provide a locking function, the fact that an intruder may have access to it does not decrease the degree of security offered by the gate. At the very worst, such intruder could merely disable the means 62 without gaining access to the locking member 47.

Figure 7:
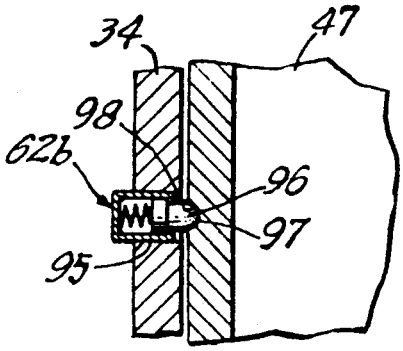
FIG. 7 is an enlarged view in section corresponding to that seen in FIG. 5, but showing a third embodiment of the invention.

In the third embodiment, as seen in FIG. 7, the mean **62*b* is further simplified. A bore 95 extends through the member 34 which is penetrated by a detent member 96 having a rounded end 97 which engages a correspondingly shaped recess 98 in the locking member 47**. The detent member engages the recess when the locking member is in its upper position. It is disengaged by imparting a downward motion to the locking member transmitted to the operating lever. This embodiment incidentally provides a braking function as the locking member is lowered after the detent is disengaged by virtue of continued contact of the detent member against a vertical surface of the locking member.

We wish it to be understood that we do not consider the invention to be limited to the precise details of structure shown and set forth in this specification, for obvious modifications will occur to those skilled in the art to which the invention pertains.

We claim:

1. In a window gate having a relatively fixed frame element adapted to be installed in a window opening, and a pivotally mounted gate element supported within an opening in said frame element, manual locking means for securing said gate in coplanar relation with said frame element, said locking means including a hollow elongated channel-forming member on a vertical edge of said gate element, said channel-forming member having an opening therein for access to the interior thereof by a user, said opening being accessible from only one side of said frame element, and a plurality of spaced openings disposed within said channel-forming member; an elongated bar slideably disposed within said channel-forming member for manual vertical axial movement between first and second positions, means on said bar for manual engagement therewith for such movement, said bar having plural locking openings positioned therealong selectively alignable with one of said plurality of openings in said channel-forming member, corresponding plural locking projections on said frame element positioned opposite said plural openings in said channel-forming member when said gate element is in coplanar position with said frame element, downward movement of said bar to one of said first and second positions serving to engage said plural locking openings in said bar with said corresponding locking projections on said frame element, the improvement comprising: means for selectively engaging and maintaining said bar in the other of said first and second positions whereby to maintain said locking openings and projections on said frame element in disengaged condition against the force of gravity.

2. The improvement set forth in claim 1, further characterized in said channel-forming member and said locking bar having selectively aligned openings, wherein said last-mentioned means includes a housing mounted upon said gate element, a slideably arranged latch member carried by said housing, resilient means urging said latch member into engagement with said selectively aligned openings, and manually engageable means for moving said latch member out of engagement with said openings to permit said locking bar to fall under the force of gravity to locking position.

3. The improvement set forth in claim 1, further characterized in said channel-forming member having a resiliently urged detent member projecting outwardly thereof, said bar having a corresponding recess therein selectively engaged when said bar is in its upper position, said detent member being disengaged from said recess by exerting a downward force upon said bar.

* * * * *